US010224627B2

(12) United States Patent
Carey et al.

(10) Patent No.: US 10,224,627 B2
(45) Date of Patent: Mar. 5, 2019

(54) ELECTRONICALLY SCANNED ANTENNA ARRAYS WITH RECONFIGURABLE PERFORMANCE

(71) Applicant: ANOKIWAVE, INC., San Diego, CA (US)

(72) Inventors: W. Timothy Carey, Cambridge, MA (US); Nitin Jain, San Diego, CA (US); Robert McMorrow, Concord, MA (US); David Warren Corman, Gilbert, AZ (US)

(73) Assignee: ANOKIWAVE, INC., San Diego, CA (US)

( * ) Notice: Subject to any disclaimer, the term of this patent is extended or adjusted under 35 U.S.C. 154(b) by 510 days.

(21) Appl. No.: 14/967,092

(22) Filed: Dec. 11, 2015

(65) Prior Publication Data

US 2017/0170556 A1 Jun. 15, 2017

(51) Int. Cl.

*H01Q 3/26* (2006.01)
*H01Q 3/38* (2006.01)
*H01Q 3/40* (2006.01)

(52) U.S. Cl.

CPC ..... *H01Q 3/2611* (2013.01); *H01Q 3/38* (2013.01); *H01Q 3/40* (2013.01); *H01Q 3/2629* (2013.01)

(58) Field of Classification Search

CPC ..... H03M 1/201; H04B 1/0007; H04B 7/086; H04B 7/04; H04B 7/0619; H01Q 3/26; H01Q 3/2629; H01Q 21/29; H01Q 3/24; H01Q 3/2611; H01Q 3/38; H01Q 3/40; H04L 25/0206; G01S 3/48; G01S 7/4052; G01S 7/52028; G01S 7/2813

See application file for complete search history.

(56) References Cited

U.S. PATENT DOCUMENTS 5,363,111 A * 11/1994 Murphy ..... G01S 7/2813 342/380
5,406,949 A * 4/1995 Yao ..... G01S 7/52028 600/447
6,415,140 B1 * 7/2002 Benjamin ..... H01Q 3/24 455/137
6,486,828 B1 * 11/2002 Cahn ..... E21B 43/26 342/363
6,731,234 B1 * 5/2004 Hager ..... G01S 13/18 342/120
9,059,770 B2 * 6/2015 Koifman ..... H04L 5/0023
2006/0058656 A1 * 3/2006 Kristoffersen ..... G01S 7/5203 600/437

(Continued)

*Primary Examiner* — Olumide Ajibade Akonai

(74) *Attorney, Agent, or Firm* — Mintz Levin Cohn Ferris Glovsky and Popeo, P.C.

(57) ABSTRACT

An apparatus may include a plurality of antenna elements forming an antenna array. The apparatus may further include a beamformer that determines one or more of phase and amplitude shifts to cause the plurality of antenna elements to produce a beam in the direction of a target. The apparatus may further include a null limiter comprising dither circuits. The dither circuits may dither the one or more of phase and amplitude shifts by adding noise to cause a side lobe of the beam to increase above a threshold value. The dither circuits may be enabled by a control signal, and the dithered one or more of phase and amplitude shifts may be provided to the antenna elements to produce the beam in the direction of the target with the side lobes above the threshold value.

20 Claims, 8 Drawing Sheets

(56) References Cited

U.S. PATENT DOCUMENTS

2006/0119492 A1* 6/2006 Kim ..... H03M 1/0614
341/143
2015/0244387 A1* 8/2015 Fleishman ..... H03M 1/201
341/131

* cited by examiner

500

Antenna Gain

| RMS Amplitude Noise (520) | 0 | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|---|
| 0.500 | -10.7 | -10.7 | -10.6 | -10.6 | -10.5 | -10.3 | -10.2 | -10.0 | -9.8 | -9.6 | -9.4 | -9.1 | -8.9 | -8.6 | -8.4 | -8.1 | -7.9 | -7.6 | -7.4 | -7.1 | -6.8 |
| 0.475 | -11.1 | -11.1 | -11.0 | -10.9 | -10.8 | -10.7 | -10.5 | -10.3 | -10.1 | -9.9 | -9.7 | 9.4 | -9.2 | -8.9 | -8.6 | -8.4 | -8.1 | -7.8 | -7.5 | -7.3 | -7.0 |
| 0.450 | -11.1 | -11.1 | -11.0 | -10.9 | -10.8 | -10.7 | -10.5 | -10.3 | -10.1 | -9.9 | -9.7 | -9.4 | -9.2 | -8.9 | -8.6 | -8.4 | -8.1 | -7.8 | -7.5 | -7.3 | -7.0 |
| 0.425 | -11.8 | -11.8 | -11.7 | -11.6 | -11.5 | -11.3 | -11.1 | -10.9 | -10.7 | -10.4 | -10.2 | -9.9 | -9.6 | -9.3 | -9.0 | -8.7 | -8.4 | -8.1 | -7.8 | -7.5 | -7.3 |
| 0.400 | -12.1 | -12.1 | -12.0 | -11.9 | -11.8 | -11.6 | -11.4 | -11.2 | -10.9 | -10.6 | -10.4 | -10.1 | -9.8 | -9.5 | -9.2 | -8.9 | -8.5 | -8.2 | -7.9 | -7.7 | -7.4 |
| 0.375 | -12.7 | -12.7 | -12.6 | -12.5 | -12.3 | -12.1 | -11.9 | -11.6 | -11.4 | -11.1 | -10.7 | -10.4 | -10.1 | -9.8 | -9.5 | -9.1 | -8.8 | -8.5 | -8.2 | -7.9 | -7.6 |
| 0.350 | -12.9 | -12.9 | -12.8 | -12.7 | -12.5 | -12.3 | -12.1 | -11.8 | -11.5 | -11.2 | -10.9 | -10.5 | -10.2 | -9.9 | -9.5 | -9.2 | -8.9 | -8.6 | -8.2 | -7.9 | -7.6 |
| 0.325 | -13.3 | -13.3 | -13.2 | -13.1 | -12.9 | -12.6 | -12.4 | -12.1 | -11.8 | -11.5 | -11.1 | -10.8 | -10.4 | -10.1 | -9.7 | -9.4 | -9.0 | -8.7 | -8.4 | -8.0 | 7.7 |
| 0.300 | -14.3 | -14.3 | -14.2 | -14.0 | -13.8 | -13.5 | -13.2 | -12.8 | -12.5 | -12.1 | -11.7 | -11.3 | -10.9 | -10.5 | -10.1 | -9.8 | -9.4 | -9.0 | -8.7 | -8.3 | -8.0 |
| 0.275 | -15.3 | -15.3 | -15.1 | -14.9 | -14.6 | -14.3 | -13.9 | -13.5 | -13.1 | -12.7 | -12.2 | -11.8 | -11.3 | -10.9 | -10.5 | -10.1 | -9.7 | -9.3 | -8.9 | -8.6 | -8.2 |
| 0.250 | -15.9 | -15.8 | -15.7 | -15.5 | -15.1 | -14.8 | -14.4 | -13.9 | -13.4 | -13.0 | -12.5 | -12.0 | -11.6 | -11.1 | -10.7 | -10.3 | -9.8 | -9.4 | -9.1 | -8.7 | -8.3 |
| 0.225 | -16.6 | -16.5 | -16.4 | -16.1 | -15.7 | -15.3 | -14.8 | -14.3 | -13.8 | -13.3 | -12.8 | -12.3 | -11.8 | -11.3 | -10.9 | -10.4 | -10.0 | -9.6 | -9.2 | -8.8 | -8.4 |
| 0.200 | -17.2 | -17.1 | -16.9 | -16.6 | -16.2 | -15.7 | -15.2 | -14.7 | -14.1 | -13.6 | -13.1 | -12.5 | -12.0 | -11.5 | -11.0 | -10.6 | -10.1 | -9.7 | -9.3 | -8.9 | -8.5 |
| 0.175 | -19.4 | -19.3 | -19.0 | -18.5 | -17.9 | -17.2 | -16.5 | -15.8 | -15.1 | -14.4 | -13.8 | -13.2 | -12.6 | -12.0 | -11.5 | -11.0 | -10.5 | -10.0 | -9.6 | -9.2 | -8.8 |
| 0.150 | -20.3 | -20.2 | -19.8 | -19.2 | -18.5 | -17.7 | -16.9 | -16.2 | -15.4 | -14.7 | -14.0 | -13.4 | -12.7 | -12.2 | -11.6 | -11.1 | -10.6 | -10.1 | -9.7 | -9.2 | -8.8 |
| 0.125 | -21.1 | -20.9 | -20.5 | -19.8 | -19.0 | -18.1 | -17.3 | -16.4 | -15.6 | -15.4 | -14.2 | -13.5 | -12.9 | -12.3 | -11.7 | 11.2 | -10.7 | -10.2 | -9.7 | -9.3 | -8.9 |
| 0.100 | -23.9 | -23.6 | -22.8 | -21.7 | -20.5 | -19.3 | -18.2 | -17.2 | -16.3 | -15.4 | -14.6 | -13.9 | -13.2 | -12.6 | -12.0 | -11.4 | -10.9 | -10.4 | -9.9 | -9.4 | -9.0 |
| 0.075 | -25.9 | -25.4 | -24.2 | -22.7 | -21.3 | -19.9 | -18.7 | -17.6 | -16.6 | -15.6 | -14.8 | -14.0 | -13.3 | -12.7 | -12.1 | -11.5 | -10.9 | -10.4 | -9.9 | -9.5 | -9.1 |
| 0.050 | -29.2 | -28.2 | -26.2 | -24.0 | -22.2 | -20.5 | -19.1 | -17.9 | -16.8 | -15.9 | -15.0 | -14.2 | -13.5 | -12.8 | -12.2 | -11.6 | -11.0 | -10.5 | -10.0 | -9.5 | -9.1 |
| 0.025 | -35.7 | -32.4 | -28.3 | -25.2 | -22.9 | -21.0 | -19.5 | -18.2 | -17.0 | -16.0 | -15.1 | -14.3 | -13.6 | -12.9 | -12.2 | -11.6 | -11.1 | -10.5 | -10.0 | -9.6 | -9.1 |
| 0.000 | -Inf | -35.2 | -29.1 | -25.6 | -23.1 | -21.2 | -19.6 | -18.3 | -17.1 | -16.1 | -15.2 | -14.3 | -13.6 | -12.9 | -12.2 | -11.6 | -11.1 | -10.6 | -10.1 | -9.6 | -9.1 |

RMS Phase Noise (deg) (510)

FIG. 5

ELECTRONICALLY SCANNED ANTENNA ARRAYS WITH RECONFIGURABLE PERFORMANCE

TECHNICAL FIELD

The subject matter described herein relates to antennas that are active electronically scanned arrays.

BACKGROUND

Electrically steerable antenna arrays such as active electronically scanned antennas (AESAs), or phased arrays, are used in a wide variety of communications systems. Many cellular telephone base stations, satellite communications ground stations, and military communications systems use electrically steerable antennas. Some of the performance metrics used to evaluate electrically steered antennas include antenna gain, null depth, beamwidth, scanning angle, frequency of operation, bandwidth, power dissipation, size, as well as other metrics. Some countries limit the export of some electrically steerable antennas when the performance metrics exceed certain values. Antennas that are export restricted often have military application or include other sensitive capability.

SUMMARY

Methods, apparatuses, computer program products, and computer readable media are disclosed herein. In one aspect, an apparatus includes a plurality of antenna elements forming an antenna array. The apparatus may further include a beamformer that determines one or more of phase and amplitude shifts to cause the plurality of antenna elements to produce a beam in the direction of a target. The apparatus may further include a null limiter comprising dither circuits. The dither circuits may dither the one or more of phase and amplitude shifts by adding noise to cause a side lobe of the beam to increase above a threshold value. The dithered one or more of phase and amplitude shifts may be provided to the antenna elements to produce the beam in the direction of the target with the side lobes above the threshold value.

In some variations, one or more of the features disclosed herein including the following features can optionally be included in any feasible combination. A dither circuit may include a digital noise generating circuit to produce a sequence of random bits, and/or a logic circuit to introduce the sequence of random bits into a value in a phase or amplitude register at a sequence of times, wherein the introduction of the random bits causes the side lobe of the beam to increase above the threshold value. The dither circuit may include a first ninety-degree hybrid to separate an input into an in-phase component and a quadrature component. The dither circuit may further include a first variable gain amplifier to amplify the in-phase component, wherein a first gain of the first variable gain amplifier is controlled by a first noise source. The dither circuit may further include a second variable gain amplifier to amplify the quadrature component, wherein a second gain of the second variable gain amplifier is controlled by a second noise source. The dither circuit may include a first in-phase combiner to produce a dithered output, wherein an amplitude of the dithered output may be determined by a first output amplitude from the first variable gain amplifier and a second output amplitude from the second variable gain amplifier. A phase of the dithered output may be determined by a ratio of the first output amplitude and the second output amplitude. The null limiter may be enabled by a control input. The control input may be selectable to cause the null limiter to be active or inactive. When the null limiter is selected to be active, the one or more of phase and amplitude shifts may be dithered and the antenna array may produce the null depth at, or above, the threshold value. When the null limiter is selected to be inactive, the one or more of phase and amplitude shifts may not be dithered and the antenna array may produce the null depth below the threshold value. The control input may be selected as active or inactive according to one or more fuses internal to the null limiter. The control input may be selected as active when a digital value provided to the null limiter does not match a digital key stored in the null limiter. The control input may be selected as inactive when the digital value provided to the null limiter matches the digital key stored in the null limiter. The apparatus is configured as a transmit antenna and/or as a receive antenna. The beam may be a null in antenna gain and/or may be a peak in antenna gain.

The above-noted aspects and features may be implemented in systems, apparatuses, methods, and/or computer-readable media depending on the desired configuration. The details of one or more variations of the subject matter described herein are set forth in the accompanying drawings and the description below. Features and advantages of the subject matter described herein will be apparent from the description and drawings, and from the claims. In some exemplary embodiments, one of more variations may be made as well as described in the detailed description below and/or as described in the following features.

DESCRIPTION OF DRAWINGS

FIG. 5 depicts examples of antenna side-lobe values for combinations of amplitude noise levels and phase noise levels, in accordance with some example embodiments.

Like reference symbols in the various drawings indicate like elements.

DETAILED DESCRIPTION

Figure 1:
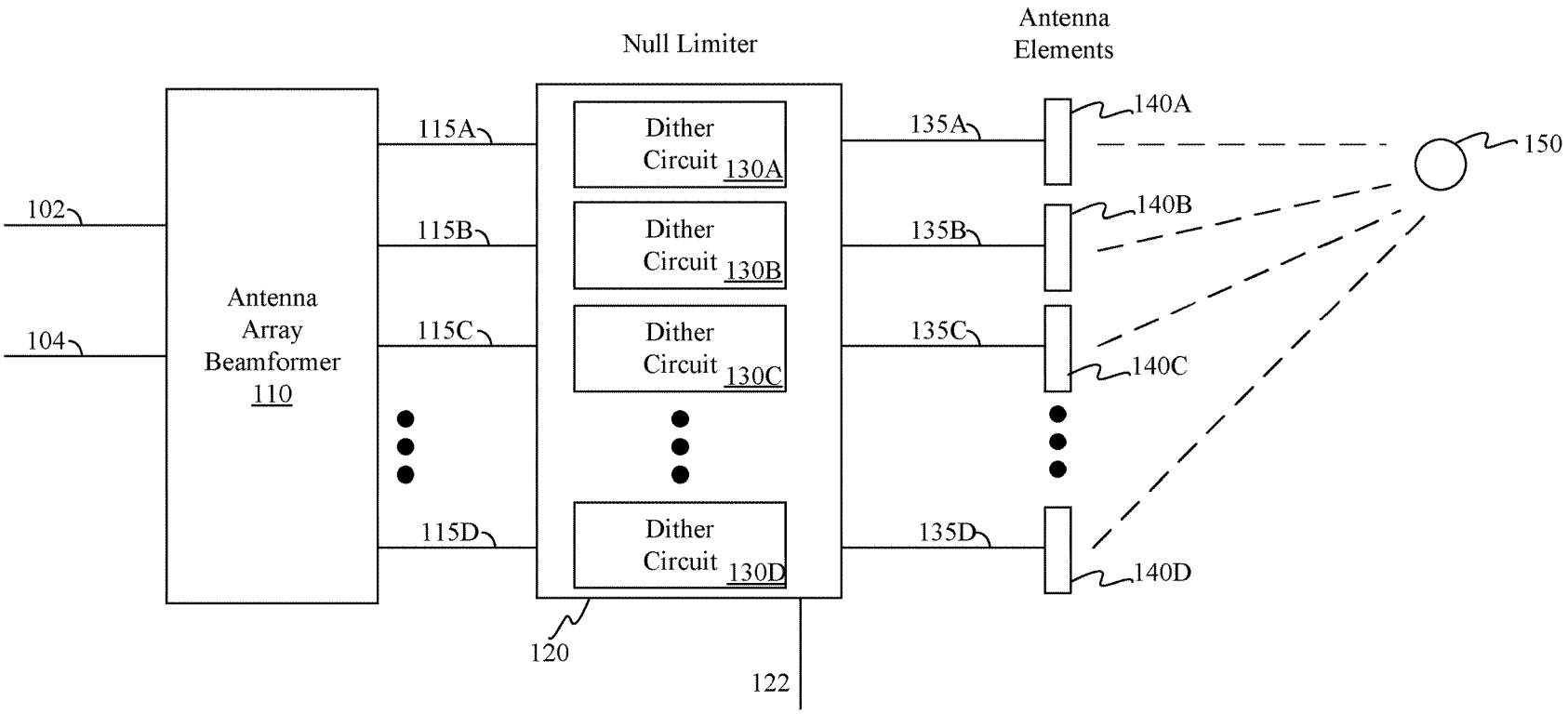
FIG. 1 depicts an example of an electrically steerable antenna including a null limiter, in accordance with some example embodiments.

Active electronically scanned antennas (AESAs) may form electronically steerable beams by controlling the phase and amplitude of signals to/from multiple antenna elements. For a transmit antenna, the phase and amplitude of signals provided to multiple radiating elements may be configured to cause the combined radiated fields from the antenna elements to produce a transmit beam in a reconfigurable direction. For a receive antenna, the phase and amplitude of signals received at the multiple antenna elements may be combined to cause radiated fields impinging on the antenna elements to produce a receive beam in a reconfigurable direction.

Active electronically scanned antennas produce peaks in gain and nulls in gain. Active electronically scanned antennas may produce nulls that are too deep to be allowable for export to certain countries. Some example embodiments increase the amplitudes of the nulls to a level that is exportable by adding noise that causes the antenna nulls to rise. In some example embodiments, the noise may be selectable to allow the same antenna to produce deep nulls for U.S. domestic sales (or approved foreign countries) and higher nulls for international sales. Without loss of generality, the following may refer to a transmit antenna where the same process may be applied to a receive antenna, and the following may refer to a receive antenna where the same or similar process may be applied to a transmit antenna.

To form a beam that spatially points in a reconfigurable direction, beam steering may be applied so that energy radiated from each of the radiating elements is combined in-phase in the reconfigurable direction. By electronically adjusting the phase and/or amplitude of the signals to the radiating elements, the direction in which the beam points is reconfigured. The reconfigurability of the direction in which the antenna beam points may allow the antenna to track moving objects or point multiple targets in rapid succession. As used herein, a "beam" may correspond to a direction in which the combined radiated fields from the antenna elements (or the combined received signals) produce antenna gain that is greater than an isotropic radiator. The beam may point in a range of angles and the direction of the beam may be the direction corresponding to the peak antenna gain. For example, a beam may have an antenna gain that is 30 decibels above an isotropic radiator (30 dBi), in a direction that is 10 degrees from the boresight of the antenna on one axis and 25 degrees from boresignt on a another axis. The direction may be reconfigured to a different direction by adjusting the phase and/or amplitude of the signals provided to, and radiated from, the multiple antenna elements. The phase adjustment and amplitude adjustment applied to the signal provided to an antenna element may be referred to as a complex beam weight. The real part of the complex beam weight may correspond to an amplitude adjustment to the antenna signal (and corresponding radiated field), and the imaginary part of the complex beam weight may correspond to a phase adjustment to the antenna signal.

Some active electronically scanned antennas (AESAs) may form one or more steerable nulls in addition to one or more steerable beams. A null may be a reconfigurable direction in which the antenna has greatly reduced gain. To form a null that spatially points in a reconfigurable direction, null steering may be applied so that energy radiated from each of the radiating elements is combined out of phase in the reconfigurable null direction. By electronically adjusting the phase and/or amplitude of the signals to/from the radiating elements, the direction in which the null points is reconfigured. The reconfigurability of the direction in which the antenna null points may allow the antenna as a receive antenna to sharply reduce the effect of jammers or undesired signals, or as a transmit antenna to reduce the radiated fields directed toward an undesired receiver. As used herein, a "null" may correspond to a direction in which the combined radiated fields from the antenna elements (or the combined received signals) produce an antenna gain that is less than an isotropic radiator. The null points in a range of angles and the direction of the null may be the direction corresponding to a minimum antenna gain. For example, a null may have an antenna gain that is −20 dBi or 20 decibels below an isotropic radiator, in a direction that is 15 degrees from the boresight of the antenna on one axis and 20 degrees from boresignt on a another axis. A "null depth" may be the gain below an isotropic radiator, or in the previous example 20 dBi. The direction may be reconfigured to a different direction by adjusting the phase and/or amplitude of the signals provided to, and radiated from, the multiple antenna elements. The phase adjustment and amplitude adjustment applied to the signal provided to an antenna element may be a complex beam weight.

Beams and nulls may be simultaneously produced by an active electronically scanned antenna by determining the beam weights for each element to produce one or more beams and/or one or more nulls in chosen directions. Nulls may be used to reduce the effect of jamming signals, noise, and interferers on the performance of the radar or communication system using the active electronically scanned antenna.

In some example embodiments, a null depth may be controlled via a control signal to be deeper (for example, a 30 dBi null) in one configuration, and less deep (for example, a 20 dBi null) in another configuration. In some example embodiments, the active electronically scanned antenna may be switched from the deeper null (30 dBi null, antenna gain of −30 dBi) in one logic state of the control signal to a less deep null in another logic state (20 dBi null, antenna gain of −20 dBi). In some example embodiments, the logic state of the control signal may be determined by a "fuse" within the active electronically scanned antenna. The fuse may be "blown" or left "unblown" at the time of manufacture and may not be reconfigurable after manufacture. A fuse that may be blown" (connection broken) or left "unblown (connection left unbroken) may be referred to as a fuse that is "blowable." In some example embodiments, the logic state of the control signal may correspond to whether a digital value provided by a system or user matches a digital key stored in the antenna. If the digital value matches, the antenna may be configured to provide deep nulls, and if the digital value does not match, the antenna may be configured to provide less deep nulls. Other mechanisms to determine the logic state of the control signal may be used as well. In some example embodiments, multiple fuses or multiple digital keys may be used where the depth of the nulls depends on which fuses are "blown" or which digital value is used. Continuing the previous example, another fuse or another digital value may cause the antenna to be configured to provide a 25 dBi null. Depending on which fuse is "blown" or which digital value is used, the antenna may be configured to provide a 20 dBi, 25 dBi, or 30 dBi null. Additional fuses or digital values may also be included that correspond to other null depths. The fuses or digital values may be used to reduce antenna peaks in place of or in addition to the null depths.

In some example embodiments, the null depth of an electrically steered antenna may be controlled by a null limiter. When a control signal activates the null limiter, a radio frequency signal(s) to one or more of the antenna elements in an active electronically scanned antenna may be altered by variable gain amplifiers controlled by noise. The noise controlled variable gain amplifiers may cause a null depth that is less deep than without the null limiter.

In some example embodiments, when the control signal activates the null limiter, digital inputs controlling the phase and/or amplitude of the radio frequency signals to the antenna elements may be altered by adding digital noise. The digital noise may cause a null depth that is less deep than without the null limiter.

FIG. 1 depicts an example of an electrically steerable antenna with a null limiter, in accordance with some example embodiments. The operation of a transmit antenna, a receive antenna, and a combined transit/receive antenna are detailed below.

In some example embodiments, FIG. 1 depicts a transmit active electronically scanned antenna 100. Beamformer 110 may generate beamformer signals 115A-115D corresponding to phase and/or amplitude shifted versions of radio frequency signal 102. The phase and/or amplitude shifts may be selected to produce one or more beams and/or one or more nulls in directions selected via pointing control signal 104. The direction of each beam and/or each null may be selected via pointing control signal 104. Antenna beams and nulls may be selected to point in different directions. The active electronically scanned antenna may have any practical quantity of antenna elements. For example, the active electronically scanned antenna 100 may have 16, 128, 1024, or any other quantity of antenna elements. When activated by control signal 122, null limiter 120 including dither circuits 130A-130D may alter the phases and/or amplitudes of beamformer signals 115A-115D to produce antenna element signals 135A-135D that cause antenna elements 140A-140D to produce one or more nulls with null depths no deeper than a threshold value.

In some example embodiments, the logic state of a control signal such as control signal 122 may be determined by a fuse that is "blown" or left "unblown at the time of manufacture of null limiter 120. For example, the fuse may be accessible on the interior of null limiter 120 before the manufacture of null limiter 120 is complete, and inaccessible after manufacture is complete. In some example embodiments, the fuse may be accessible from the exterior of null limiter 120 after manufacture is complete, wherein when the fuse that is internal to null limiter 120 is "blown" from the exterior, the fuse is permanently set as "blown" and permanently causes the logic state of control signal 122 to cause less deep nulls. In some example embodiments, the state of control signal 122 may be determined by the fuse which may be internal to null limiter 120, or may be internal to beamformer 110. For example, a blowable fuse may be included in an integrated circuit implementing all or part of null limiter 120. The blowable fuse may cause control signal 122 to be in the state causing null limiter 120 and dither circuits 130A-130D to be disabled when the fuse is not blown. The blowable fuse may cause control signal 122 to be in another state such as enabling null limiter 120 and dither circuits 130A-130D when the fuse is blown. In some example embodiments, the fuse may be blown (or not blown) at the time of manufacture. In this way, one integrated circuit may be produced that can perform both as a deep-null antenna when the fuse is not blown and as a less deep null antenna when the fuse is blown.

In some example embodiments, the state of control signal 122 may be controlled by an authentication. For example, a set of binary bits may be provided to null limiter 120 or active electronically scanned antenna 100. When the set of bits matches a key, then the null limiter may be disabled. When the set of bits does not match the key, the null limiter may remain enabled. In this way, the null limiter 120 may be disabled upon authentication with the correct key.

In some example embodiments, the state of control signal 122 may be determined by a global positioning system (GPS) location of the active electronically scanned antenna. For example, a GPS receiver may be included in active electronically scanned antenna 100. When the active electronically scanned antenna 100 is in a location where deeper nulls are allowed, the state of the control signal 122 may be set to disable the null limiter. When the active electronically scanned antenna 100 is in a location where deeper nulls are not allowed, the state of the control signal 122 may be set to enable the null limiter. Other mechanisms to determine when to enable/disable the null limiter may also be used.

Null limiter 120 may include one or more dither circuits, such as dither circuits 130A-130D. In some example embodiments, each dither circuit may alter a beamformer signal corresponding to an antenna element 140A-140D. For example, dither circuit 130A may alter beamformer signal 115A to produce antenna element signal 135A corresponding antenna element 140A. In some embodiments, fewer dither circuits may be used than antenna elements where some antenna elements have corresponding dither circuits and some antenna elements may not.

In some example embodiments, the dither circuits 130A-130D may include vector modulators controlled by noise to alter the phase shift and/or amplitude of the radio frequency signal to/from (transmit/receive) the antenna element associated with the dither circuit. The noise controlled vector modulator may cause the one or more nulls to have depths that are less deep than a threshold value such as 30 dB below an isotropic radiator. For example, without null limiter 120 including dither circuits 130A-130D being activated by control signal 122, beamformer 110 may produce nulls that are 30 dB below an isotropic radiator, but with the null limiter 120 and dither circuits 130A-130D being activated by control signal 122, the null depth may be altered to be a depth that is 20 dB below an isotropic radiator.

A dither circuit, such as dither circuit 130A, may include two vector modulators wherein the gain of each vector modulator is controlled by a noise source such as a white noise source. In some example embodiments, one vector modulator may modulate an in-phase component, and the other vector modulator may modulate a quadrature component. For example, a 90-degree hybrid may split a signal into an in-phase component and a quadrature component. One noise controlled vector modulator may operate on the in-phase component of an antenna (transmit or receive) signal and another noise controlled vector modulator may operate on the quadrature component. Each vector modulator may adjust the phase and/or amplitude of the in-phase or quadrature component. The amplitude and phase adjusted in-phase and quadrature components may be combined/split to produce a signal to/from an antenna element. The noise added by dither circuits 130A-130D may cause null depths in the antenna pattern that are less deep than would be possible without the dither circuits. In some example embodiments, the effect of the noise added by the dither circuits including the vector modulators is to add some random uncertainty or noise to the amplitude and/or phase of the signal provided to/from antenna elements 140A-140D which may reduce the depths of the nulls produced by the active electronically scanned antenna. In some example embodiments, the vector modulators may be included in the null limiter 120. The null limiter may be included in the array beamformer 110. Vector modulators in dither circuit 130A are further detailed in FIGS. 2A and 2B.

In some example embodiments, a dither circuit, such as dither circuit 130A may include a digital circuit. For example, dither circuit 130A may include digital registers that hold digital values to control the phase shift and/or amplitude shift applied to beamformer signal, such as beamformer signal 115A. In some example embodiments, the dither circuits 130A-130D may operate by adding noise to the digital values for the phase and/or amplitude of a beamformer signals 115A-D. For example, dither circuit 130A may add digital noise to registers controlling the phase shift and/or amplitude shift of beamformer signal 115A to produce antenna element signal 135A. For example, a dither circuit such as dither circuit 130A, may include a digital noise generator. In some example embodiments, the digital noise may be inserted into the digital representations of amplitude shift and/or phase shift using exclusive OR functions (XOR). In some example embodiments, the effect of adding digital noise into the digital representation of the amplitude and/or phase at 135A is to add some random uncertainty or noise to the amplitude and/or phase of the signal provided to antenna element 140A to reduce the depths of the nulls produced by the active electronically scanned antenna. In some example embodiments, the registers controlling the phase and/or amplitude of the signal to an antenna element may be internal to beamformer 110. In some example embodiments, digital noise is added to both phase and amplitude, and in some example embodiments digital noise is added to phase or amplitude. The digital circuity implementing dither circuit 130A is further detailed in FIG. 3A.

In some example embodiments, FIG. 1 depicts a receive active electronically scanned antenna 100. Beamformer 110 may combine phase and/or amplitude shifted versions of beamformer signals 115A-115D to produce radio frequency signal 102. The phase and/or amplitude shifts applied by beamformer 110 may be selected to produce one or more beams and one or more nulls in directions selected via pointing control signal 104. The direction of each beam and each null may be selected via pointing control signal 104. As described above with respect to a transmit, receive antenna beams and nulls may be selected to point in different directions. When activated by control signal 122, null limiter 120 including dither circuits 130A-130D, may alter the phases and/or amplitudes of antenna element signals 135A-135D to produce beamformer signals 115A-115D to cause one or more nulls with null depths no deeper than a threshold value.

Null limiter 120 may include one or mode dither circuits, such as dither circuits 130A-130D. In some example embodiments, each dither circuit may alter an antenna element signal 135A-135D corresponding to an antenna element 140A-140D. For example, dither circuit 130A may alter antenna element signal 135A corresponding to antenna element 140A to produce beamformer signal 115A. In some embodiments, fewer dither circuits may be used than antenna elements where some elements have corresponding dither circuits and some antenna elements may not.

In some example embodiments, the dither circuits 130A-130D may operate by inserting vector modulators controlled by noise to alter the phase and/or amplitude shifts of the radio frequency signal from the antenna element associated with the dither circuit. The noise controlled vector modulators may cause the one or more nulls to have depths that are less deep than a threshold value. In the receive antenna, the dither circuits 130A-130D apply noise to the antenna element signals 135A-135D that are combined at the beamformer 110. In some example embodiments, digital registers may hold digital values that control the phase shift and/or amplitude shift applied to an antenna element signal, such as antenna element signal 135A, to produce a beamformer signal, such as beamformer signal 115A. The dither circuits in the receive antenna may operate according to the foregoing description. In some example embodiments, the registers controlling the phase and/or amplitude of the signal to an antenna element may be internal to beamformer 110. In some example embodiments, digital noise is added to both phase and amplitude, and in some example embodiments digital noise is added to phase or amplitude.

In some example embodiments, FIG. 1 depicts an antenna that may perform as a transmit antenna and a receive antenna. Antenna elements such as antenna element 140A may be used for transmission and reception. In some example embodiments, two null limiters 120 may be used, one for receive and one for transmit. In some example embodiments, two beamformers 110 may be used, one for receive and one for transmit. The receive and transmit antennas may operate in accordance with the forgoing descriptions.

In some example embodiments, beamformer 110 may be implemented in an integrated circuit. In some example embodiments, null limiter 120 may be implemented in an integrated circuit. In some example embodiments, beamformer 110 and null limiter 120 may be implemented in the same integrated circuit. Beamformer 110 and/or null limiter 120 may be implemented as digital integrated circuits, analog integrated circuits, mixed-signal integrated circuits, application specific integrated circuits, programmable logic devices, field programmable gate arrays, processors including executable code, or any combination of these. The integrated circuits may use any suitable semiconductor process or combination of processes.

Figure 2A:
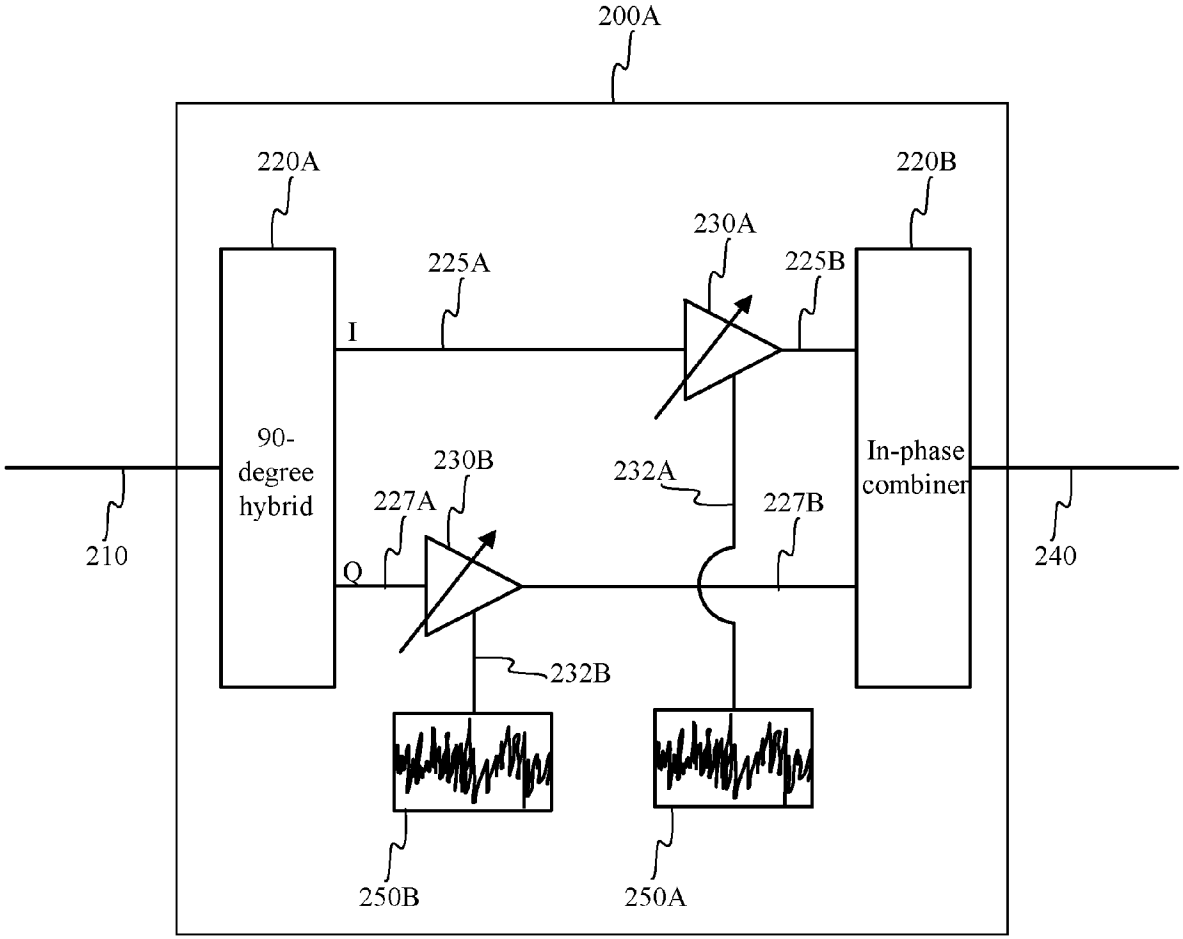
FIG. 2A depicts an example of a dither circuit including a noise controlled variable gain amplifier, in accordance with some example embodiments.

FIG. 2A depicts an example of a dither circuit 200A consistent with dither circuits 130A-130D in FIG. 1. Dither circuit 200A may include two noise controlled modulators. Dither circuit 200A may modify the amplitude and phase of radio frequency input signal 210. Dither circuit 200A may include 90-degree hybrid 220A, in-phase combiner 220B, noise generators 250A-B, and variable gain amplifiers 230A-B. In-phase combiner 220B may be a Wilkinson combiner or other in-phase power combiner. Other electronic components may be used in dither circuit 200A as well. The description of FIG. 2A also refers to FIG. 1. In some example embodiments, noise sources 250A and 250B may be correlated and in some example embodiments noise sources 250A and 250B may be uncorrelated.

In some example embodiments, 90-degree hybrid 220A may split input radio frequency signal 210 into an in-phase component 225A and quadrature component 227A. About half of the power of input signal 210 may be provided at 225A and the remaining power of input signal 210 may be phase shifted 90-degrees and provided at 227A.

In some example embodiments, 90-degree hybrid 220A and in-phase combiner 220B may be passive microwave devices. In some example embodiments, 90-degree hybrid 220A and/or in-phase combiner 220B may include active components such as transistors and/or nonlinear materials such as ferromagnetic materials. In some example embodiments, 90-degree hybrid 220A and in-phase hybrid 220B may be implemented digitally with a programmable device such as a computer, programmable logic device (PLD), or field programmable gate array (FPGA). In some example embodiments, 90-degree hybrid 220A and in-phase hybrid 220B may include a combination of the foregoing devices. In some example embodiments, 220A and/or 220B may be 270-degree hybrids or other angle hybrids. In some example embodiments, 220A-220B may be optical hybrids, or acoustic hybrids.

Variable gain amplifier 230A may amplify in-phase component 225A, and variable gain amplifier 230B may amplify quadrature component 225B. Each variable gain amplifier 230A/230B may include a gain control input. The gain to the input signal 225A/227A to produce the output signal 225B/227B of the amplifier 230A/230B may be controlled via the gain control input 232A/232B. For example, variable gain amplifier 230A may apply a gain to 225A to produce 225B. In some example embodiments, the gain control input may be a voltage applied to the gain control input or a current supplied to the gain control input. For example, variable gain amplifier 230A may accept a voltage between 0 volts and 5 volts at gain control input 232A. In this example, the gain of variable gain amplifier 230A may be 3 dB when a voltage at gain control input 232A is 0 volts, and the gain may be 23 dB when the voltage at gain control input 232A is 5 volts. In some example embodiments, the gain control input may be a digital input. For example, gain control input 232A may be a 16-bit digital word. For example, when a digital value of 0000 (hex) is present at gain control input 232A, the gain may be 10 dB and when a digital value of FFFF (hex) is present at gain control input 232A, the gain may be 30 dB. Other quantities of bits and other corresponding gains may also be used.

In some example embodiments, a noise generator may be provided to the gain control input of each variable gain amplifier. In some example embodiments, voltage or current and/or digital noise sources may be applied to the gain control input. For example, a voltage noise generator 250A may be applied to gain control input 232A of variable gain amplifier 230A, and another voltage noise generator 250B may be applied to gain control input 232B of variable gain amplifier 230B. Noise generators 250A-250B may be white noise generators such as uniformly distributed white Gaussian noise generators. Other types of noise generators may be used as well. In some example embodiments, noise generators 250A and 250B are independent noise generators. In some example embodiments, noise sources 250A and 250B may be correlated and in some example embodiments noise sources 250A and 250B may be uncorrelated. In some example embodiments, noise generators 250A-250B may be digital noise generators. For example, a digital noise generator may produce white noise as 16-bit words.

In some example embodiments, 90-degree hybrid 220A may produce in-phase component 225A that is amplified by variable gain amplifier 230A with gain control input 232A connected to noise generator 250A. Noise controlled variable gain amplifier 230A may produce output 225B with an amplitude that varies according to input 225A multiplied by the gain that is controlled by noise generator 250A. Causing noise source 250A to produce a higher amplitude of noise may cause a larger variation in the amplitude at output 225B. 90-degree hybrid 220A may produce quadrature phase component 227A that is amplified by variable gain amplifier 230B with gain control input 232B connected to noise generator 250B. Noise controlled variable gain amplifier 230B may produce output 227B with an amplitude that varies according to input 227A multiplied by the gain that is controlled by noise generator 250B. Causing a higher amplitude of noise to be produced from noise source 250B may cause a larger variation in the amplitude at output 227B.

In some example embodiments, the amplitude of the output 240 from in-phase combiner 220B may be representative of the amplitude of the output 225B of variable gain amplifier 230A and the output 227B of variable gain amplifier 230B. For example, the amplitude at 240 may be equal to, or proportional to, the square root of the sum of the squared amplitudes at 225B and 227B. In some example embodiments, the phase of the output 240 from in-phase combiner 220B may be representative of the phase at 225B and/or 227B. For example, the phase at 240 may be equal to, or nearly equal to, a sum of the phase at 227B of 225B and an adjustment value, wherein the adjustment value is related to the arctangent of a ratio of the amplitudes of 225B and 227B. For example, 90-degree hybrid 220A may transform the amplitude, E, of input signal 210 into an in-phase amplitude, C, at 225A and quadrature amplitude, D, at 227A. Variable gain amplifier 230A with gain controlled by noise source 250A may produce output 225B with time-varying amplitude, A. Variable gain amplifier 230B with gain controlled by noise source 250A may produce output 227B with time-varying amplitude, B. In some example embodiments, in-phase combiner 220B may combine the signals 225B and 227B. Continuing the previous example, the amplitude of the signal at 240 may be equal to, or proportional to, the square root of the sum of $A^2$ and $B^2$. In this example, the phase at 240 may be equal to, or proportional to, the phase at 225B and/or 227B with a phase adjustment added to the phase at 225B or 227B. For example, the phase adjustment may be equal to, or proportional to, the arctangent of A divided by B. In this way, the amplitude and phase at 240 are modulated or adjusted according to noise sources 250A and 250B. In some example embodiments, in-phase combiner 220B may be replaced with an in-phase splitter and 90-degree hybrid 220A may be replaced with a quadrature hybrid.

Figure 2B:
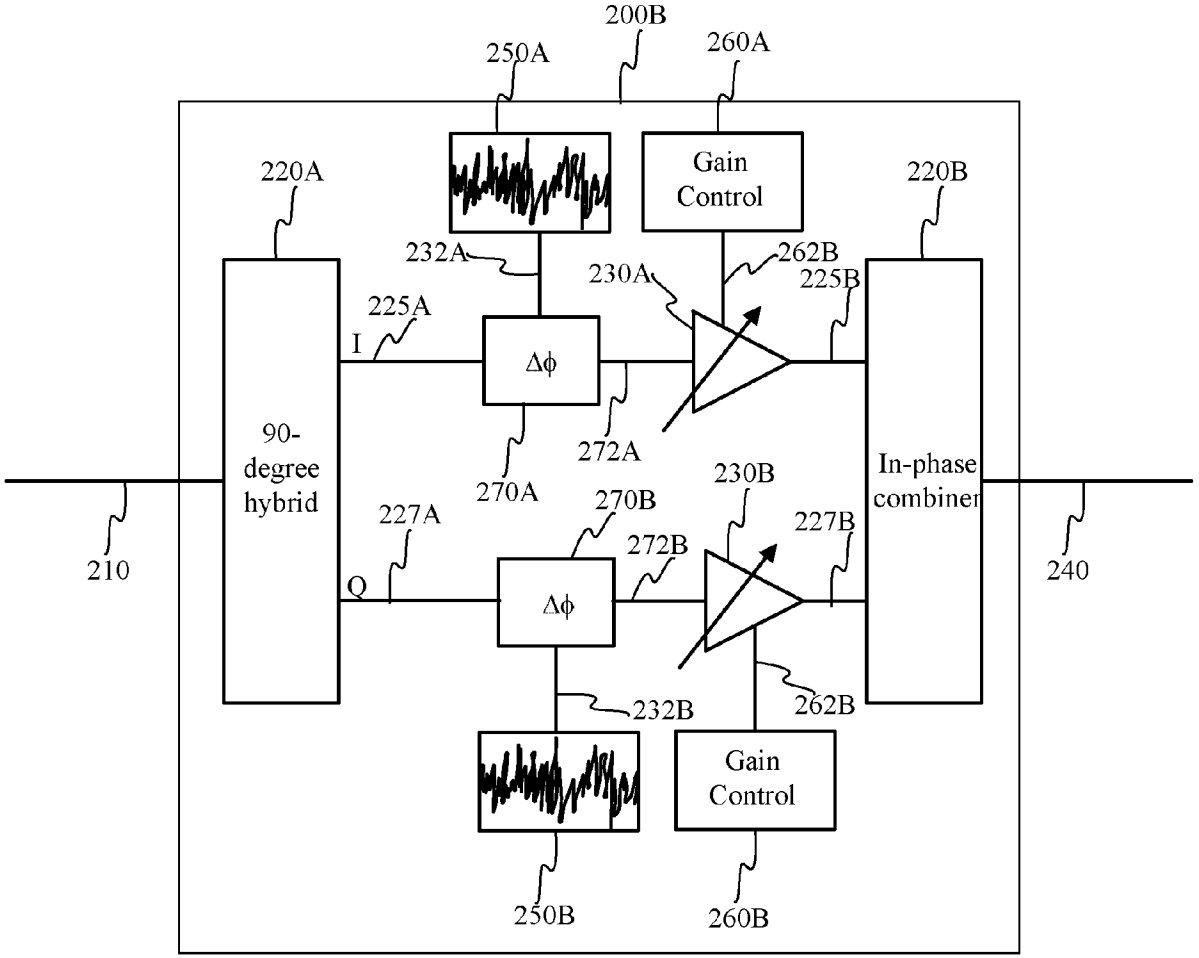
FIG. 2B depicts another example of a dither circuit including a noise controlled phase shifter, in accordance with some example embodiments.

FIG. 2B depicts another example of a dither circuit 200B consistent with dither circuits 130A-130D in FIG. 1. Dither circuit 200B may include two noise controlled phase shifters, in accordance with some example embodiments. In some example embodiments, dither circuit 200B may modify the amplitude and phase of radio frequency input signal 210. The dither circuit may include 90-degree hybrid 220A, in-phase combiner 220B, noise generators 250A-B, variable gain amplifiers 230A-B, and phase shifters 270A and 270B. Other electronic components may be used in dither circuit 200B as well. The description of FIG. 2B also refers to FIGS. 1 and 2A. In some example embodiments, noise sources 250A and 250B may be correlated and in some example embodiments noise sources 250A and 250B may be uncorrelated. In some example embodiments, noise generators 250A-250B may be digital noise generators.

In some example embodiments, a noise generators may be provided to the phase control inputs of phase shifters such as phase shifters 270A and 270B. In some example embodiments, voltage, current, and/or digital noise sources may be applied to a phase control input. In some example embodiments, as the control input is varied, the difference in phase between the input to the phase shifter and the output of the phase shifter may be adjusted in accordance with the control voltage. For example, a voltage noise generator 250A may be applied to phase control input 232A of phase shifter 270A to adjust the difference in phase between 225A and 272A in accordance with 250A. Another voltage noise generator 250B may be applied to phase control input 232B of phase shifter 270B to adjust the difference in phase between 227A and 272B in accordance with 250B.

Variable gain amplifier 230A may amplify 272A from phase shifter 270A, and variable gain amplifier 230B may amplify 272B from phase shifter 270B. Each variable gain amplifier 230A-230B may include a gain control input. The gain of the amplifier applied to the input signal to produce the output signal may be controlled via the gain control input. For example, variable gain amplifier 230A may apply a gain to 272A to produce 225B. In some example embodiments, the gain control input may be a voltage applied to the gain control input, a current supplied to the gain control input, or a digital value provided to the gain control input as described above with respect to FIG. 2A.

In some example embodiments, 90-degree hybrid 220A may produce in-phase component 225A that is phase shifted by phase shifter 270A with phase control input 232A connected to noise generator 250A, and amplified by variable gain amplifier 230A. Variable gain amplifier 230A may produce output 225B with amplitude that varies according to input 272A multiplied by the gain that is controlled by signal 262A from gain control 260A. 90-degree hybrid 220A may produce quadrature phase component 227A that is amplified by variable gain amplifier 230B according to gain control input 262B. Variable gain amplifier 230B may produce output 227B with amplitude that varies according to input 272B multiplied by the gain that is controlled by signal 262B from gain control 260A.

As described with respect to FIG. 2B, the phase of signal 225B may be adjusted by the noise controlled phase shifter 270A, and the phase of signal 227B may be adjusted by the noise controlled phase shifter 270B. The amplitude of signal 225B may be adjusted by variable gain amplifier 230A controlled by gain control 262A from gain control 260A, and the amplitude of signal 227B may be adjusted by variable gain amplifier 230B controlled by gain control 262B from gain control 260B. In some example embodiments, one or more of gain controls 260A and 260B may be controlled by noise sources (not shown in FIG. 2B) similar to noise sources 250A and 250B. The amplitude and phase of the output 240 may depend on 225B and 227B in FIG. 2B in the manner described above with respect to FIG. 2A. For example, the amplitude at 240 may be proportional to the square root of the sum of the squared amplitudes at 225B and 227B, and the phase may be adjusted by an amount related to the arctangent of a ratio of the amplitudes at 225B and 227B.

Figure 3A:
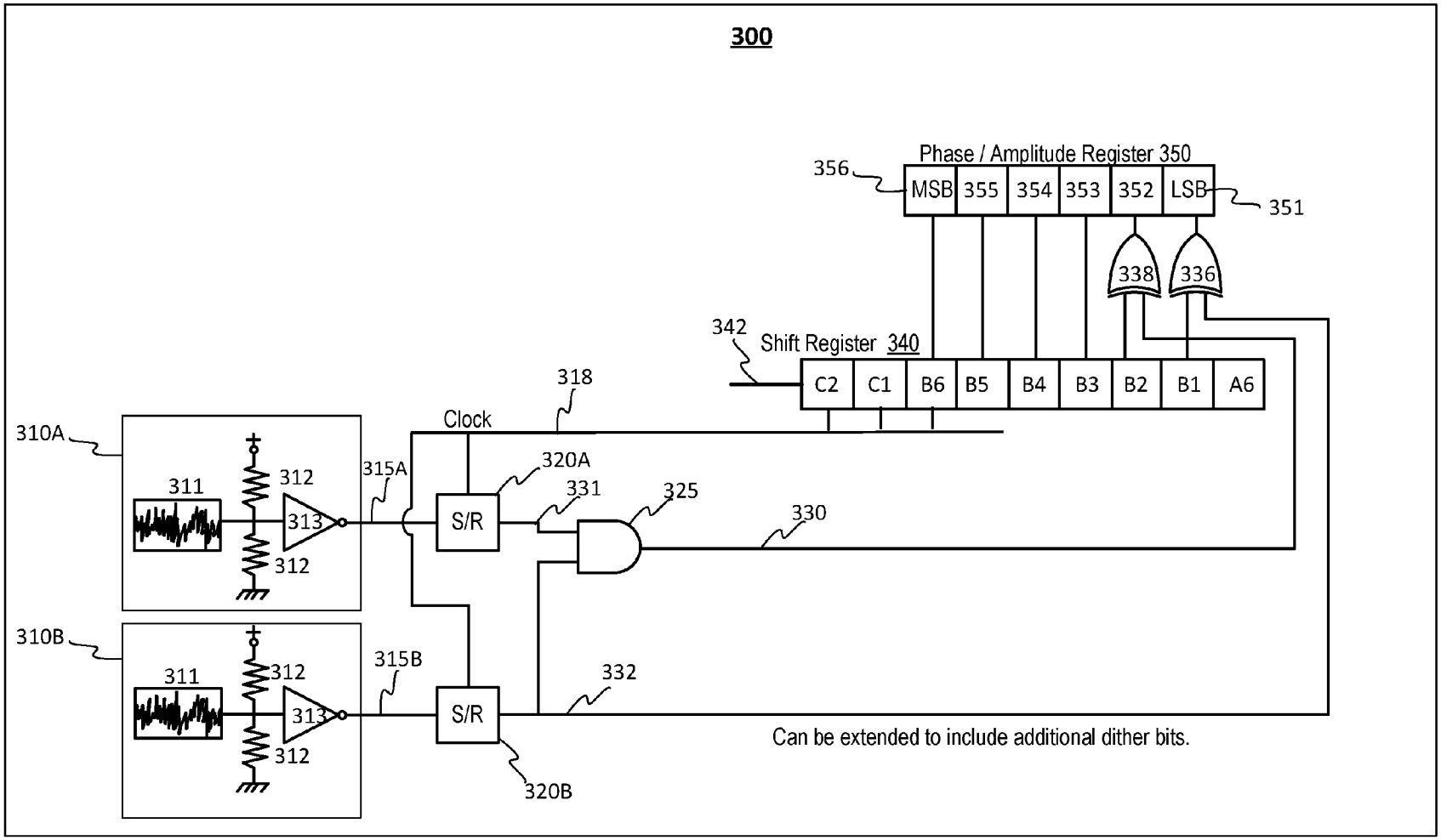
FIG. 3A depicts another example of a dither circuit including digitally controlled dithering, in accordance with some example embodiments.

FIG. 3A depicts another example of a dither circuit, in accordance with some example embodiments. FIG. 3A also refers to FIGS. 1, 2A, and 2B. Dither circuit 300 may add digital noise 330/332 from noise sources 310A /310B to one or more bits of a binary representation of phase shift or amplitude associated with an antenna element. In some example embodiments, each antenna element 140A-140D may have a separate corresponding dither circuit, or some antenna elements may have a corresponding dither circuit and some may not. Dither circuits 130A-130D may add digital noise to the digital representations of a phase shift and/or amplitude to reduce the depths of nulls produced by the combined antenna elements 140A-140D. The description of FIG. 3A also refers to FIG. 1.

In some example embodiments, beamformer 110 may produce digital representations of phase shifts and/or amplitudes to cause antenna elements 140A-140D to produce one or more beams and/or nulls. In some example embodiments, beamformer signal 115A may include the binary representations of the phase shift and/or amplitude corresponding to antenna element 140A, and beamformer signal 115A may include a radio frequency transmit or receive signal. For a transmit antenna 100, the digital representations of phase shifts and amplitudes may be passed across 115A-115D, and may be applied to the transmit radio frequency signals also passed across 115A-115D. For a receive antenna 100, the digital representations of phase shifts and amplitudes may be passed across 115A-115D, and may be applied to antenna element signals 135A-135D before being passed to beamformer 110 via the radio frequency interface included in beamformer signals 115A-115D.

In some example embodiments, beamformer signal 115A may include a serial or parallel digital interface to pass the digital representations of a phase shift and/or amplitude and may include an analog interface such as a coaxial transmission line or other radio frequency interface for a transmit/receive signal. When the phase shifts and amplitudes carried on the digital interface included in beamformer signal 115A are applied, and the dither circuits are disabled via a null limiter control signal, antenna elements 140A-40D may produce the one or more beams and one or more deep nulls. The deep nulls may represent antenna performance that may sold in a limited number of countries that have been approved for export. When the phase shifts and amplitudes carried in the digital interface included in beamformer signal 115A are applied, and the dither circuits are enabled via the null limiter control signal, antenna elements 140A-40D may produce the one or more beams and one or more nulls with a shallower depth than when the dither circuits are disabled. The shallower nulls may represent antenna performance that may be sold in more countries than antennas with the deep null performance. For example, when the dither circuits are enabled, the null depth(s) may be limited to 20 dBi (or, −20 dBi gain), and when not enabled the null depth may be deeper, such as 30 dBi (or, −30 dBi gain). Export of antennas with 20 dBi depths nulls may exportable to more countries than an antenna with 30 dBi depth nulls.

In some example embodiments, the serial or parallel interface included in beamformer signal 115A passes binary values for phase shift and/or amplitude to dither circuit 300. For example, shift register 340 may hold a portion of a serial bit stream 342 corresponding to a phase shift or amplitude values from beamformer 110. In some example embodiments, register 340 may hold a binary value determining the phase shift and/or amplitude values to apply to a radio frequency signal from beamformer signal 115A for a transmit antenna. In some example embodiments, register 340 may hold a binary value determining the phase shift and/or amplitude values to apply to a radio frequency signal to the antenna element signal 135A for a receive antenna. Shift register 340 may be latched by clock 318. In some example embodiments, shift register 340 may be shifted by a quantity of bits per clock pulse 318. For example, the quantity of bits shifted per clock cycle may be equal to the binary width of the corresponding digital representation of a phase shift or amplitude. For example, when the digital representation is six bits wide as shown in FIG. 3A, shift register 340 may be shifted six bits per clock 318. Upon each clock cycle, shift register 340 may contain a replacement six-bit binary value B1-B6 in 340. In some example embodiments, a parallel interface to provide binary values B1-B6 may be used instead of shift register 340.

In some example embodiments, the binary value contained in register 350 may determine a phase shift, and another register 350 (not shown in FIG. 3A) may determine an amplitude. For example, register 350 may hold a six-bit value corresponding to the amplitude of a beamformer signal 115A. Although FIG. 3A depicts six-bit values for phase shift and/or amplitude, other quantities of bits may be used as well. In the example of FIG. 3A, the least significant bit (LSB) 351 corresponds to decimal value of 1, and the most significant bit (MSB) 356 corresponds to a decimal value of 32. The intervening bits correspond to decimal values that are powers of two between 1 and 32. As an example, the decimal value of register 350 containing 101011 is 43. In this example, because there are 64 possible states (corresponding to a 6-bit value), the least significant bit has a value of 5.625 degrees. In some example embodiments, higher values contained in register 350 may correspond to more phase shift or a higher amplitude. In this example, register 350 holds six-bit values for of amplitude or phase shift for an antenna element such as antenna element 140A. In this example, register 350 may be loaded with bits B1 (LSB) to B6 (MSB) from shift register 340. In this example, MSB 356 of register 350 is set to the binary value of B6 at serial register 340, bit 355 is set to the binary value of B5, bit 354 is set to the binary value of B4, and bit 353 is set to the binary value of B3. In the example of FIG. 3A, bit 352 is set to the binary value of B2 exclusive OR'd with noise bit 330, and 351 is set to the binary value of B1 exclusive OR'd with noise bit 332. The output of exclusive OR gate 336 (338) may be equal to a toggled value of the binary value of B1 (B2) in 340 when noise bit 332(330) has a binary value of one. For example, when 332 is a one, and B1 is a one (zero), the output of 336 is zero (one), and when 332 is a zero, and B1 is a one (zero), the output of 336 is one (zero). In this way, noise is added to LSB 351. Noise is added to B2 via noise bit 330 and exclusive OR gate 338 in a similar fashion as described above with respect to B1.

Digital noise generators 310A and 310B may produce binary values at 315A and 315B that are each equally likely to have a value of one as to have a binary value of zero. In some example embodiments, digital noise generators may include a white noise source 311 connected to a resistive divider. The resistive divider using resistors 312 may set a direct current (DC) voltage to a threshold value for toggling the output of inverter 313. When the value of noise source 311 is positive, the binary output of inverter 313 may be zero. When the value of noise source 311 is negative, the output of inverter 313 may be a binary 1. A buffer, operational amplifier, or other thresholding component may be used instead of inverter 313. Upon each clock cycle at 318, flip flop 320A may latch the output 331 to the value at 315A, and hold the latched value at 331 until the next clock cycle at 318. Upon each clock cycle at 318, flip flop 320B may latch the output 332 to the value at 315B, and hold the latched value at 332 until the next clock cycle at 318. Digital noise signal 332 may be an input to exclusive OR gate 336 with another input to 336 being B1 from serial register 340. The result of exclusive OR 336 may set the value of LSB 341 in a register 350. In some example embodiments, AND gate 325 with inputs 331 and 332 may serve to produce a noise value at 330 that has a 25% probability of being a binary one and a 75% probability of being a binary zero. In some example embodiments, AND gate 325 may be removed and flip-flop output 331 may be connected to 330. In some example embodiments, the probability of 330 being a one may be another value such as 10%, 20%, or 50%. In some example embodiments additional dither bits may be added. For example a third bit with 12.5% probability of being a binary one and 87.5% probability of being a binary zero may be included. The third bit may be added by including another exclusive OR gate with output connected to 353, one input connected to B3 at serial register 340, and another input connected to a second AND gate with two inputs. One input to the added AND gate may connect to 330 and the other input may be connected to a third digital noise generator and flip-flop.

In some example embodiments, digital noise sources 310A-310B, flop-flops 320A-320B, and AND gate 325 may be replaced with a digitally generated noise source. For example, digital noise bits 330 and 332 may be generated by a processor or programmable logic device.

Figure 3B:
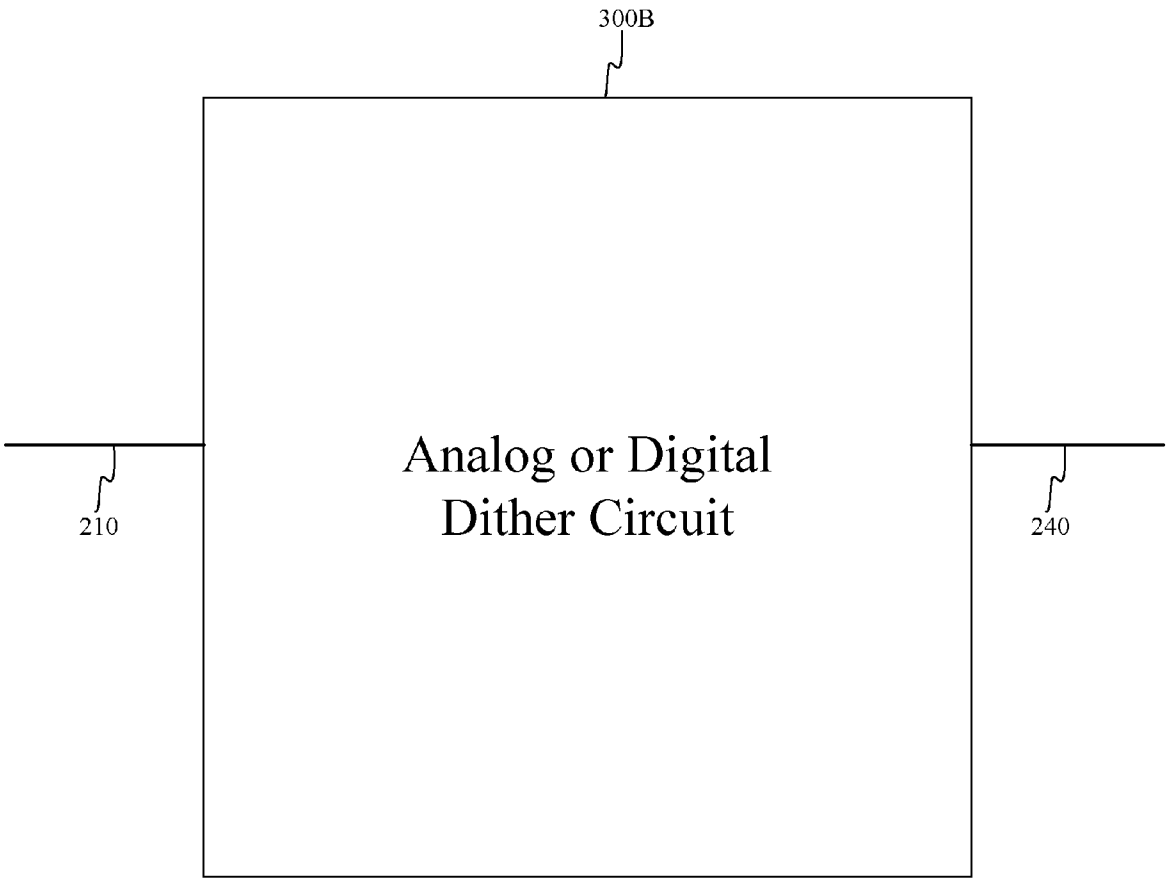
FIG. 3B depicts another example of an analog or digital dither apparatus, in accordance with some example embodiments.

FIG. 3B depicts another example of an analog or digital dither circuit, in accordance with some example embodiments. FIG. 3B also refers to FIGS. 1, 2A, 2B, and 3A. Dither circuit 300B may include the dither circuits of FIGS. 2A, 2B, 3A, and/or other circuits to implement dither circuits 130A-130D in null limiter 120. Combinations of the circuits in FIGS. 2A, 2B, and 3A are also possible. For example, the phase dithering in FIG. 2B may be combined with the amplitude dithering in FIG. 2A. The digital dithering of FIG. 3A may be applied to the amplitude or phase of a signal such as input signal 210. The digital dithering in FIG. 3A may be combined with the dithering of FIGS. 2A and/or 2B. Other circuits and/or methods may also be used to generate dithering and may be included in null limiter 120. The dithering of dither circuit 300B may be applied to an analog and/or digital input signal such as input signal 210 to dither the phase and/or amplitude of input signal 210 to produce an analog and/or digital output signal such as output signal 240.

Figure 4:
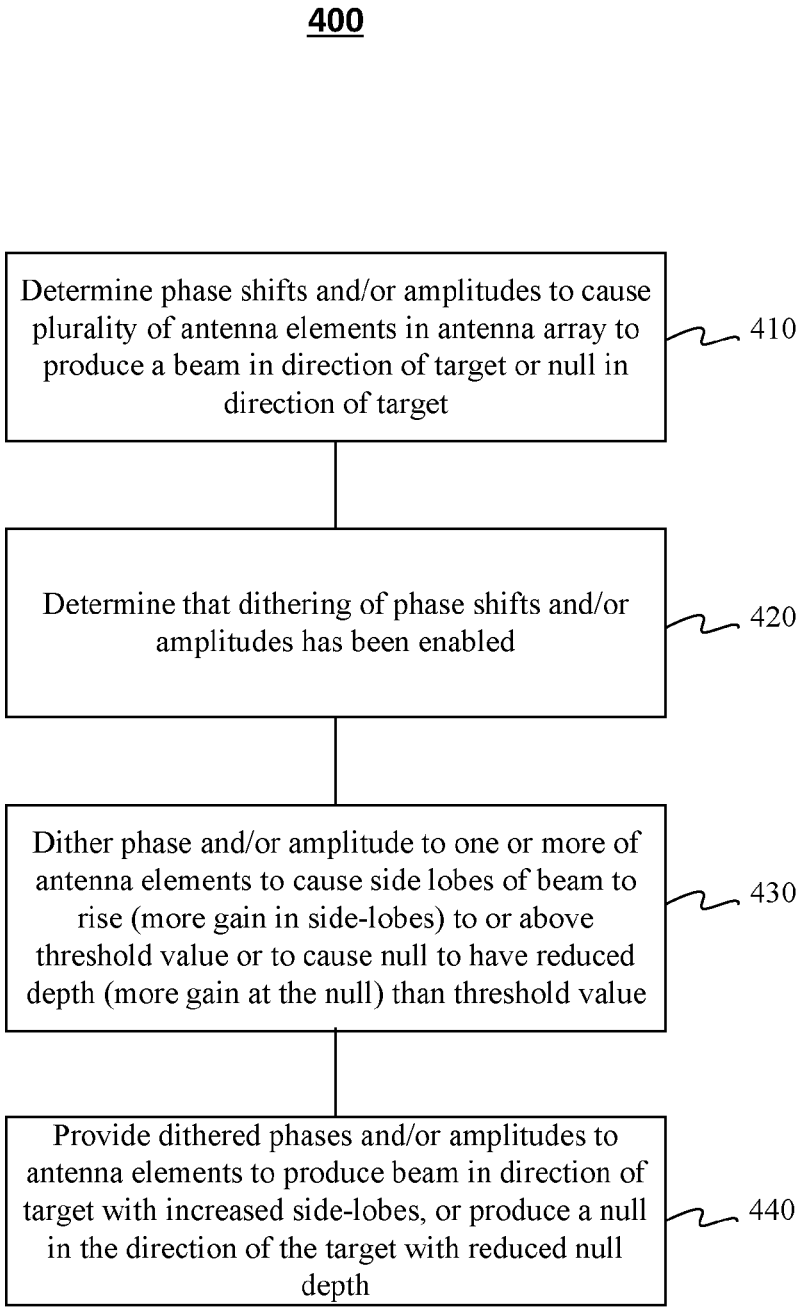
FIG. 4 depicts an example of a process for using dither to increase the side-lobes of an antenna, in accordance with some example embodiments.

FIG. 4 depicts an example of a process 400, in accordance with some example embodiments. The description of FIG. 4 also refers to FIGS. 1, 2A, 2B, and 3. At 410, phase shifts and/or amplitudes may be determined that will cause a plurality of antenna elements in an active electronically scanned antenna to produce a beam or a null in the direction of a target. The beam and/or null may include side lobes. At 420, a determination may be made whether dithering of one or more amplitudes and/or phases is enabled. At 430, when dithering is enabled, the one or more amplitudes and/or phases may be dithered to cause the side lobes of a beam to rise (more gain in the side-lobes) or to cause a null to have a reduced depth (more gain at the null). At 440, a beam with the increased side-lobes, or a null with reduced null depth may be produced by the antenna elements of the active electronically scanned antenna. The description of FIG. 4 also refers to FIG. 1.

At 410, a beamformer may determine phase shifts and/or amplitudes that will cause a plurality of antenna elements in an active electronically scanned antenna to produce a beam or a null in the direction of a target. For example, a beamformer may determine phase shifts and amplitudes for each of the antenna elements in an array to cause the elements to produce a beam that points in the direction of a target. The phase shifts and amplitudes may produce, when a null limiter 120 is disabled, a beam with 25 dBi gain in the main beam and having side-lobes with a RMS side-lobe level of −30 dBi. The beamformer 120 may determine the phase shifts and/or amplitudes as analog or digital values. The phase shifts and/or amplitudes may be passed from a beamfrormer such as beamformer 110 to null limiter 120.

At 420, a determination may be made whether dithering of one or more amplitudes and/or phases is enabled. For example, control signal 122 may determine whether null limiter 120 including dither circuits such as dither circuits 130A-130D are enabled. For example, the logic state of control signal 122 may determine whether null limiter is enabled or disabled. The logic state may be determined using any of the mechanisms described in FIG. 1.

At 430, when null limiter 120 is enabled, dithering of the antenna phase shifts and/or amplitudes may cause the side lobes of a beam to rise (more gain in side-lobes) or to cause a null to have a reduced depth (more gain at the null). Each antenna element such as antenna elements 140A-140D may have corresponding dither circuits 130A-130D or a subset of the antenna elements may have dither circuits. The dither circuits may be implemented consistent with FIGS. 2A, 2B, 3A, and/or 3B.

At 440, a beam with the increased side-lobes, or a null with reduced null depth may be produced by the antenna elements of the active electronically scanned antenna. For example, a transmit beam and/or receive beam and/or null may be produced in accordance with the description of FIG. 1. For example, a null may be produced in the direction of a target with a null depth of 20 dBi when null limiter 120 is enabled, where the null depth would be 30 dBi when the null limiter 120 is disabled. In another example, a beam with 25 dBi gain in the main beam and an RMS side-lobe level of −20 dBi when null limiter 120 is enabled, where the beam would have 25 dBi gain with an RMS side-lobe level of −30 dBi when the null limiter 120 is disabled.

FIG. 5 depicts example antenna beam side-lobe values for combinations of amplitude noise levels and phase noise levels, in accordance with some example embodiments. The description of FIG. 5 also refers to FIG. 1. A dither circuit such as dither circuit 130A may cause an amplitude noise to a beamformer amplitude value or phase noise to a beamformer phase shift value. Root-mean-square (RMS) amplitude noise is shown on vertical axis 520. RMS phase noise is shown on horizontal axis 510. For each combination of RMS amplitude noise and RMS phase noise, a corresponding antenna side-lobe level is shown as an antenna gain in dBi. Larger side-lobes have smaller negative values and smaller side-lobes have more negative values. As an example, with an RMS amplitude noise of 0.150 dB and an RMS phase noise of 2 degrees, the side-lobes are increased by the phase noise to an antenna gain of −19.8 dBi (or a null depth of 19.8 dB). By choosing an RMS amplitude noise level and/or an RMS phase noise level the beam side-lobes may be increased to a selected value. In the example of FIG. 5, a region (shown with a thicker border) where amplitude noise values below 0.15 dB and phase noise values below 5 degrees corresponds to side lobes below a −20 dBi antenna gain threshold. The values in this region would not be selected when the threshold side-lobe value is −20 dBi.

Figure 6:
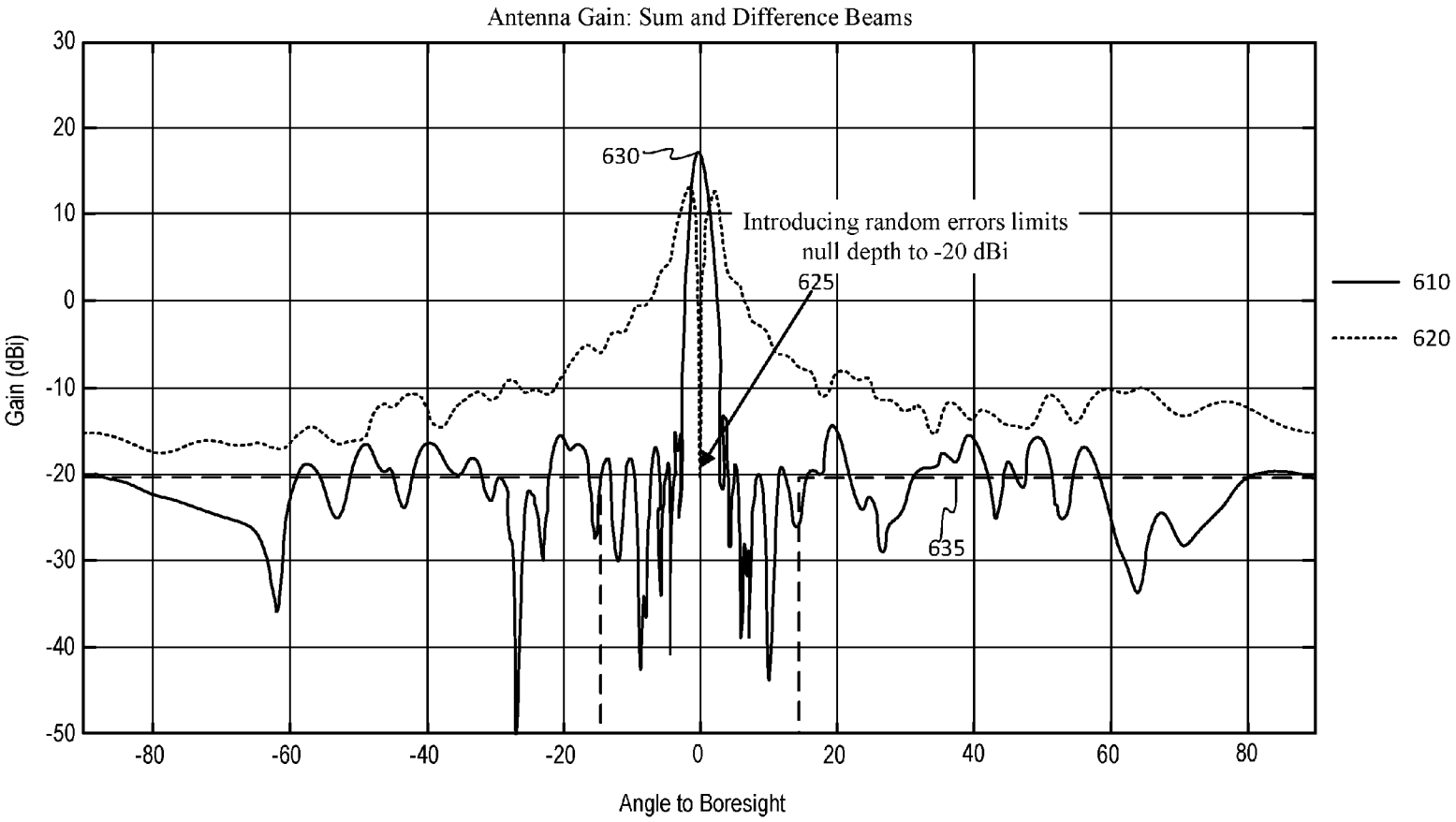
FIG. 6 depicts examples of plots of antenna gain as function of angle to boresight, in accordance with some example embodiments.

FIG. 6 depicts an example plot of antenna gain as function of angle to boresight, in accordance with some example embodiments. The description of FIG. 6 also refers to FIG. 1. FIG. 6 depicts the antenna gain for a sum beam 610 and a difference beam 620. By introducing an RMS phase error (noise) of 5 degrees into the beamformer/antenna element signals and no amplitude noise, a null depth 625 may be limited to approximately −20 dBi. In some example embodiments, dither circuits such as dither circuits 130A-130D may introduce the phase error such as a 5 degree phase error.

A sum beam is produced by summing the signals from the antenna elements such as antenna elements 140A-140D. The summation is performed by selecting beamformer phase shift and amplitude values to cause the antenna elements to add coherently together to produce a main beam 630. In the example of FIG. 6, the sum beam has a peak gain 630 of 17 dBi and has an RMS side-lobe level 635 of −20 dBi when the dither circuits are enabled. In some example embodiments, the RMS side-lobe level may be caused to be higher by the phase noise added by dither circuits such as dither circuits 130A-130D. For example, the RMS side-lobe level may be −30 dBi when dither circuits, such as dither circuits 130A-130D are disabled via a control signal.

A difference beam is produced by taking differences between antenna elements such as antenna elements 140A-140D. The differences are performed by selecting beamformer phase shift and amplitude values to cause the antenna elements to produces differences that together produce a main null 625. In the example of FIG. 6, the null has a depth 625 of −20 dBi that has been limited due to the phase noise added by dither circuits such as dither circuits 130A-130D. For example, the null antenna gain may be −30 dBi (null depth 30 dBi) when dither circuits, such as dither circuits 130A-130D are disabled via a control signal.

Although some of the drawings show examples of results, other results may be obtained as well.

Although the term active electronically scanned array is used in the forgoing, the subject matter herein may be applied to phased array antennas, active electronically steered antennas, active electrically steered arrays (or antennas), passive electronically (or electrically) steered arrays (or antennas), as well as any other type of active or passive electronically/electrically steered array or antenna.

Without in any way limiting the scope, interpretation, or application of the claims appearing below, a technical effect of one or more of the example embodiments disclosed herein is to provide an integrated circuit that can cause deep antenna nulls with one setting and cause shallow antenna nulls with another setting, and can be switched from the deep null setting to the shallow null setting via a control signal or permanently at the time of manufacture.

One or more aspects or features of the subject matter described herein may be realized in digital electronic circuitry, analog circuitry, mixed signal circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device (e.g., mouse, touch screen, etc.), and at least one output device.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and programmable logic devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid state memory or a magnetic hard drive or any equivalent storage medium. The machine-readable medium can alternatively or additionally store such machine instructions in a transient manner, such as for example as would a processor cache or other random access memory associated with one or more physical processor cores.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flow(s) depicted in the accompanying figures and/or described herein do not necessarily require the particular order shown, or sequential order, to achieve desirable results. Other implementations may be within the scope of the following claims.

What is claimed is:

1. An apparatus comprising:

a plurality of antenna elements forming an antenna array;

a beamformer that determines one or more of phase and amplitude shifts to cause the plurality of antenna elements to produce a beam in the direction of a target; and a null limiter comprising dither circuits that dither the one or more of phase and amplitude shifts by adding noise to cause a side lobe of the beam to increase to, or above, a threshold value, wherein the dithered one or more of phase and amplitude shifts are provided to the antenna elements to produce the beam in the direction of the target with the side lobes above the threshold value, wherein the null limiter is selectable to be active or inactive, and wherein when the null limiter is selected to be active, the one or more of phase and amplitude shifts are dithered and the antenna array produces the null depth at, or above, the threshold value.

2. The apparatus as in claim 1, wherein at least one of the dither circuits comprises:

a digital noise generating circuit to produce a sequence of random bits;

a logic circuit to introduce the sequence of random bits into a value in a phase or amplitude register at a sequence of times, wherein the introduction of the random bits causes the side lobe of the beam to increase above the threshold value.

3. The apparatus as in claim 1, wherein at least one of the dither circuits comprises:

a first ninety-degree hybrid to separate an input into an in-phase component and a quadrature component;

a first variable gain amplifier to amplify the in-phase component, wherein a first gain of the first variable gain amplifier is controlled by a first noise source;

a second variable gain amplifier to amplify the quadrature component, wherein a second gain of the second variable gain amplifier is controlled by a second noise source; and a first in-phase combiner to produce a dithered output, wherein an amplitude of the dithered output is determined by a first output amplitude from the first variable gain amplifier and a second output amplitude from the second variable gain amplifier, and wherein a phase of the dithered output is determined by a ratio of the first output amplitude and the second output amplitude.

4. The apparatus as in claim 1, wherein a control input enables the dither circuits to dither, and wherein the null limiter is selectable via the control input to be active or inactive, and wherein when the null limiter is selected to be inactive, the one or more of phase and amplitude shifts are not dithered and the antenna array produces the null depth below the threshold value.

5. The apparatus as in claim 4, wherein the control input is selected as active or inactive according to one or more fuses internal to the null limiter.

6. The apparatus as in claim 4, wherein the control input is selected as active when a digital value provided to the null limiter does not match a digital key stored in the null limiter, and wherein the control input is selected as inactive when the digital value provided to the null limiter matches the digital key stored in the null limiter.

7. The apparatus as in claim 1, wherein the apparatus is configured as a transmit antenna.

8. The apparatus as in claim 1, wherein the apparatus is configured as a receive antenna.

9. The apparatus as in claim 1, wherein the beam is a null in antenna gain.

10. The apparatus as in claim 1, wherein the beam is a peak in antenna gain.

11. A method comprising:

forming an antenna array from a plurality of antenna elements;

determining one or more of phase and amplitude shifts to cause the plurality of antenna elements to produce a beam in the direction of a target; and dithering one or more of phase and amplitude shifts by adding noise to cause a side lobe of the beam to increase to, or above, a threshold value, wherein the dithered one or more of phase and amplitude shifts are provided to the antenna elements to produce the beam in the direction of the target with the side lobes above the threshold value, wherein the dithering is selectable to be active or inactive, and wherein when the dithering is selected to be active, the one or more of phase and amplitude shifts are dithered and the antenna array produces the null depth at, or above, the threshold value.

12. The method as in claim 11, wherein the dithering includes generating digital noise to produce a sequence of random bits, and introducing the sequence of random bits into a value in a phase or amplitude register at a sequence of times, wherein the introduction of the random bits causes the side lobe of the beam to increase above the threshold value.

13. The method as in claim 11, wherein the dithering is performed by at least one dither circuit, wherein the dither circuit comprises:

a first ninety-degree hybrid to separate an input into an in-phase component and a quadrature component;

a first variable gain amplifier to amplify the in-phase component, wherein a first gain of the first variable gain amplifier is controlled by a first noise source;

a second variable gain amplifier to amplify the quadrature component, wherein a second gain of the second variable gain amplifier is controlled by a second noise source; and a first in-phase combiner to produce a dithered output, wherein an amplitude of the dithered output is determined by a first output amplitude from the first variable gain amplifier and a second output amplitude from the second variable gain amplifier, and wherein a phase of the dithered output is determined by a ratio of the first output amplitude and the second output amplitude.

14. The method as in claim 11, wherein a control input enables the dither circuits to dither, and wherein the dithering is selectable via the control input to be active or inactive, and wherein when the dithering is selected to be inactive, the one or more of phase and amplitude shifts are not dithered and the antenna array produces the null depth below the threshold value.

15. The method as in claim 14, wherein the control input is selected as active or inactive according to one or more fuses internal to the null limiter.

16. The method as in claim 14, wherein the control input is selected as active when a digital value does not match a digital key, and wherein the control input is selected as inactive when the digital value matches the digital key.

17. The method as in claim 11, wherein the antenna array is configured as a transmit antenna.

18. The method as in claim 11, wherein the antenna array is configured as a receive antenna.

19. The method as in claim 11, wherein the beam is a null in antenna gain.

20. The method as in claim 11, wherein the beam is a peak in antenna gain.

* * * * *